US007082724B2

(12) United States Patent
Railkar et al.

(10) Patent No.: US 7,082,724 B2
(45) Date of Patent: Aug. 1, 2006

(54) PACKAGING OF TABBED COMPOSITE SHINGLES HAVING A BACKER STRIP CONTAINING UNIFORM, IDENTICALLY SPACED, VERTICAL PROJECTIONS ON ITS TOP EDGE

(75) Inventors: Sudhir Railkar, Clifton, NJ (US); Adem Chich, Kearny, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 664 days.

(21) Appl. No.: 10/287,164

(22) Filed: Nov. 4, 2002

(65) Prior Publication Data

US 2004/0084338 A1 May 6, 2004

(51) Int. Cl.
*E04D 1/26* (2006.01)

(52) U.S. Cl. ..... 52/105; 52/535; 52/521; 52/540

(58) Field of Classification Search ..... 52/521, 52/105, 535, 555, 540, 558
See application file for complete search history.

(56) References Cited

U.S. PATENT DOCUMENTS

| | | | | |
|---|---|---|---|---|
| 3,407,557 | A * | 10/1968 | Shaw | 52/555 |
| 3,921,358 | A * | 11/1975 | Bettoli | 52/314 |
| 4,717,614 | A * | 1/1988 | Bondoc et al. | 428/143 |
| 5,369,929 | A * | 12/1994 | Weaver et al. | 52/557 |
| 6,804,919 | B1 * | 10/2004 | Railkar | 52/105 |

* cited by examiner

*Primary Examiner*—Carl D. Friedman
*Assistant Examiner*—Basil Katcheves
(74) *Attorney, Agent, or Firm*—William J. Davis; Imre Balogh

(57) ABSTRACT

This invention relates to back-to-back inverse packaging of a pair of tabbed, composite roofing shingles consisting of (a) a top sheet having a lower butt portion divided into spaced tabs and an upper undivided headlap portion carrying a horizontal band of nailing indicia on the lower portion of its exposed surface; (b) a backer strip underlying the tabs of the top sheet and filling the spaces between the tabs and (c) vertical projections of approximately similar shape and spacing as the tabs, positioned on the top horizontal margin of the backer strip which projections extend upwardly beyond said band of indicia at a distance not more than one half the width of said headlap portion and which are interposed above the spaces between the tabs.

4 Claims, 3 Drawing Sheets

PACKAGING OF TABBED COMPOSITE SHINGLES HAVING A BACKER STRIP CONTAINING UNIFORM, IDENTICALLY SPACED, VERTICAL PROJECTIONS ON ITS TOP EDGE

FIELD OF THE INVENTION

The invention relates to the improved substantially flat, ridge-free back-to-back packaging of composite roofing shingles to minimize or eliminate breakage and distortion of shingle components and to the composite shingle uniquely adapted to said manner of packaging.

BACKGROUND OF THE INVENTION

Bulk stacking and breakage of composite shingles during packaging, shipment and storage are recurring problems which are particularly acerbated in the case of composite shingles involving backer strips having irregular planar surfaces containing tabs and projections as disclosed in co-pending patent application Ser. No. 10/252,950, filed on Sep. 23, 2002.

Accordingly, it is an object of this invention to minimize or substantially eliminate ridges and local stress sites in the packaging of composite shingles containing backer strips having uneven planar surfaces.

Another object is to provide a commercially feasible and economical process for the packaging and manufacture of composite roofing shingles Still another object is to provide a composite shingle uniquely adapted to ridgeless packaging.

These and other objects and benefits of the invention will become apparent from the following description and disclosure.

SUMMARY OF THE INVENTION

In accordance with this invention there is provided a unique composite shingle arrangement and a method of packaging pairs of the composite shingle units, each unit comprising a tabbed top sheet and a backer strip having vertical uniform projections disposed longitudinally along its top edge margin, by reversed and back-to-back placement of an identical pair of shingles so that the projections on the shingle undersurfaces in the package are interposed and preferably in abutment.

DETAILED DESCRIPTION OF THE INVENTION

This invention is particularly directed to the composite roofing shingles described in patent application Ser. No. 10/252,950, filed on Sep. 23, 2002, the disclosure of which is incorporated herein by reference with the proviso that in the present invention, the width of the backer strip is not only sufficient to completely fill the spaces between the top sheet tabs, but the projections on the backer strip extend not more than half the width of the headlap portion of the top sheet, are evenly spaced, and preferably uniformly shaped and are alternately positioned with the top sheet tabs so that each projection is located above a space between the tabs.

In accordance with a preferred manufacture of a pair of totally nestable composite shingle units, a length of shingle material on a conveyer belt is programmed to simultaneously cut a reversibly imaged pair of shingle units comprising dimensionally matching top sheets each containing an undivided headlap portion having a horizontal band of nailing indicia on the lower exposed surface of the headlap and a butt portion depending from the headlap and containing a plurality of evenly spaced tabs. The top or bottom undivided horizontal edge of one of the headlap portion is additionally coded in an imaged pattern denoting a pair of backer strips having horizontally disposed projections which extend not more than one half the width of said headlap; each of said backer strips being programmed to have similarly shaped, evenly spaced projections in abutting relationship. In this arrangement, the top and bottom members in each pair of the composite shingle units are produced in a single and economical cutting operation. Alternatively, the top undivided margins of each top sheet headlap can be programmed to cut separated backer strips at opposite sides of the shingle membrane so that the above described projections face outwardly in the cutting pattern. Of course, it is equally acceptable to produce individual top sheets and backer strips separately. In the later case, the tabs of the top sheet may be varied in a complementary shape or in a somewhat less than abutable spacing relationship. However, to completely eliminate ridges in the packaging of shingle stacks, pairs having tabs and projections of substantially identical shape and spacing are preferred. In this way both the projections of the backer and the tabs of the top sheet are nested when stacks of back-to-back, inversely mounted pairs of shingles are packaged.

Figure 1:
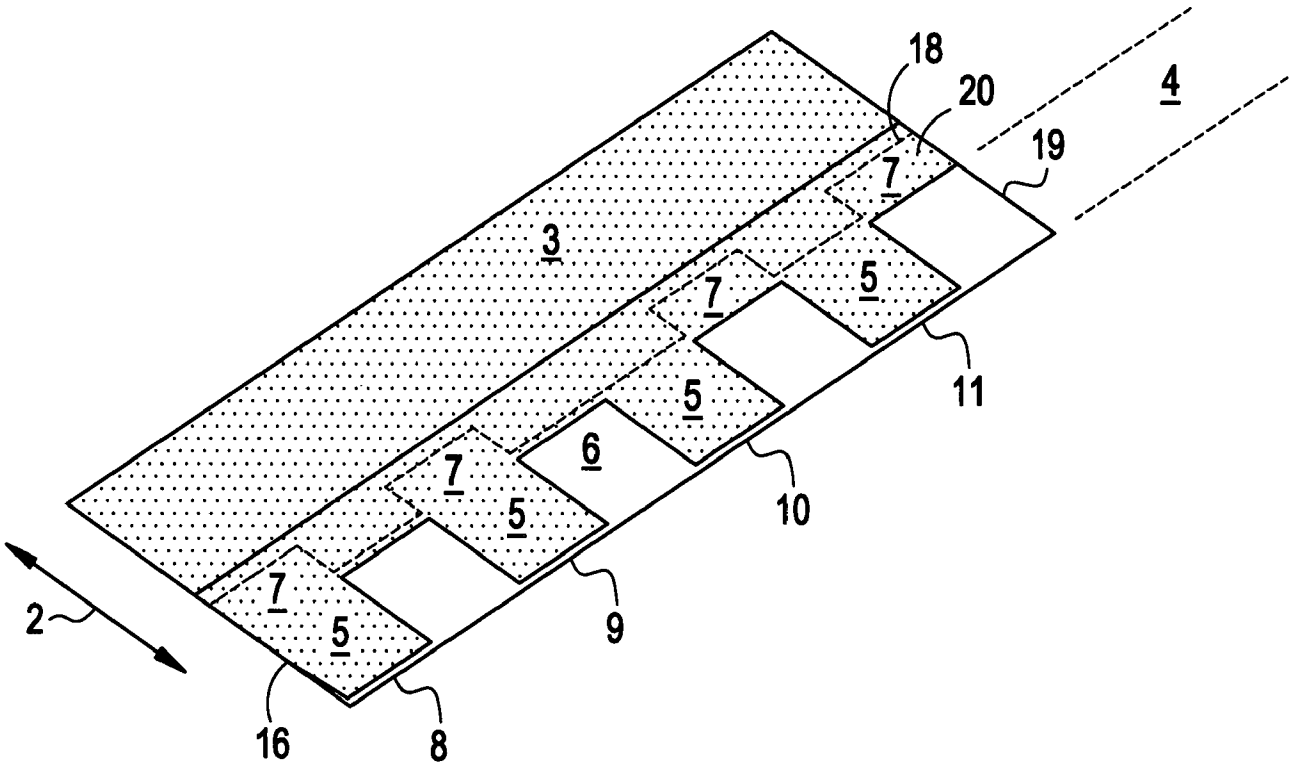
FIG. 1 is a perspective view of an assembled composite shingle of the invention.

In accordance with FIG. 1 of the drawings, illustrating assembly of members for a preferred composite shingle unit after completion of the cutting operation and separation of component members, backer strip 6 having uniform projections 7 on its horizontal top margin is mounted under stippled top sheet having substantially identical tabs 5 in butt portion 4. A horizontal band of nailing indicia 20 is indicated on the lower top surface of headlap portion 2 above butt portion 4. Backer strip 6, which fills the spaces between the tabs 5 of top sheet 3, is positioned so that projections 7 extend vertically above band 20 and are located above the spaces between the tabs, as indicated by broken line 18.

Figure 2:
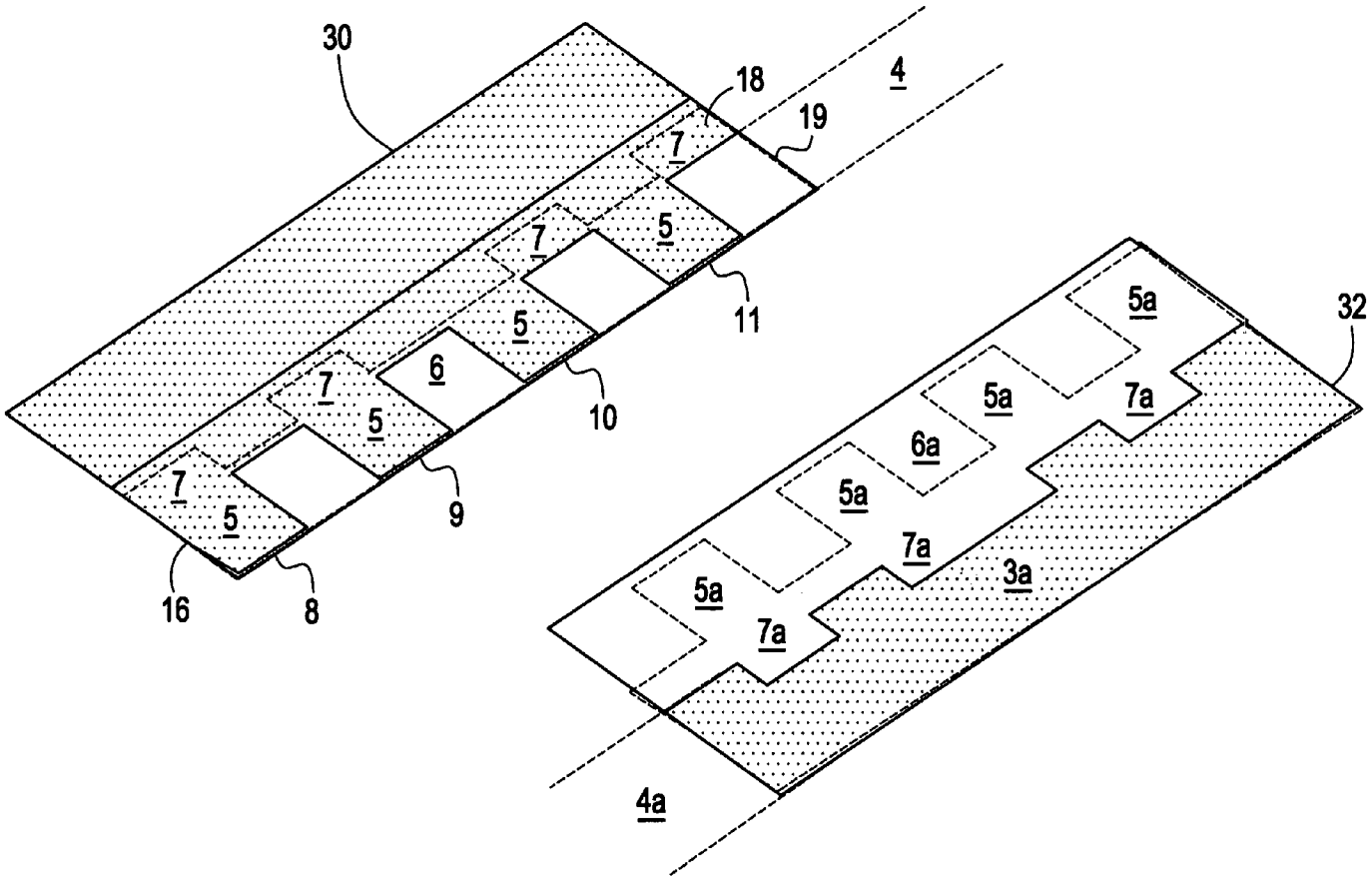
FIG. 2 is a perspective elevational view of packaging a pair of the present shingles and FIG. 3 is a side view of a packaged pair of the present shingles.

FIG. 2 is a elevational view of the ridgeless packaging of a pair of mirror imaged shingles wherein the projections 7 of a first composite shingle 30 are interposed between projections 7*a* of second composite shingle 32. As shown in the drawing, the top and under surfaces of second shingle 32 are reversed and the shingle is inverted so that projections 7*a* of backer strip 6*a* mesh or nest with projections 7 on the undersurface of shingle 30. As is apparent, when a second similarly assembled pair of shingles is placed over the first, the respective tabs of the two pairs are also nested. Packaging pairs of composite shingles in this manner completely eliminates ridges caused by spaces between the projections and between tabs when the shingles are stacked.

Figure 3:
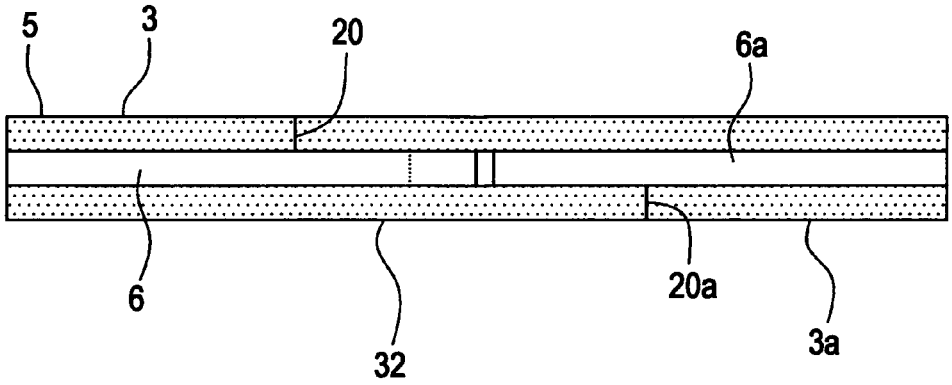

A side view of the mounted pair of the above shingles is shown in FIG. 3 wherein the pair of shingles are packed back-to-back and side edges of projections 7 and 7*a* are approximately or exactly in abutting relationship and the free horizontal edges are closely positioned.

Figure 4:
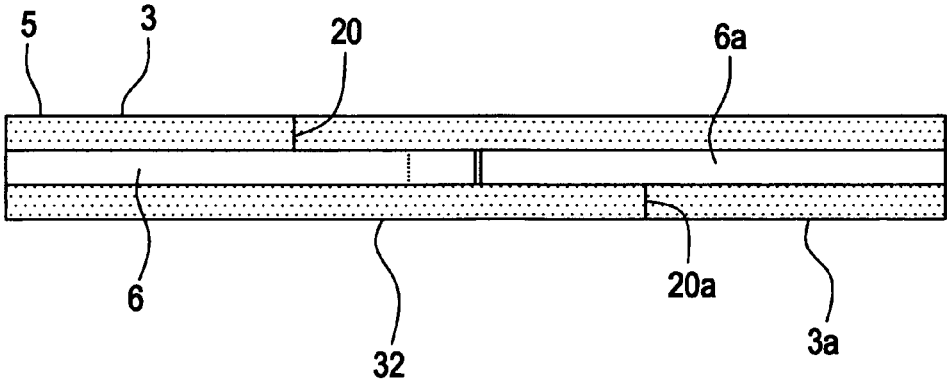
FIG. 4 is a side view of a preferred embodiment of a packaged pair of the present shingles.

A side view of a preferred embodiment of a mounted pair of the present shingles is shown in FIG. 4 wherein all free edges between projections 7 and 7*a* are abutting or in interlocking position to present a substantially ridgeless interface.

As modifications of the above FIG. 1, the backer strip can extend below the top sheet tabs for a shadow affect and/or the entire divided portion of the backer can extend somewhat above band 20 under top sheet 3 by a distance not more than half the breadth of the headlap portion. Also, the projections of the backer strips in a pair of composite shingles can have any reciprocal shapes or spacings for nestable contact with opposing projections on the backer of the second shingle unit. Several variations in the shape of backer projections are illustrated in the above referenced, co-pending patent application. However, in a preferred embodiment, the backer projections are at least approximately identical with the shape and spacing of the top sheet tabs.

What is claimed is:

1. A composite roofing shingle comprising: (a) a top sheet having an undivided headlap portion having a width and a lower butt portion containing a plurality of spaced tabs having empty spaces therebetween; (b) a backer strip having a top horizontal margin adapted to underlay said top sheet and to fill the empty spaces between said plurality of spaced tabs; and (c) vertical projections positioned on the top horizontal margin of the backer strip which projections extend upwardly at a distance not more than one half the width of said headlap portion and said projections are interposed above the spaces between the tabs, wherein the projections have approximately the same shape and spacing as the tabs.

2. The packaging of the composite shingle of claim 1 in pairs which comprise positioning a first shingle of the pair over a second shingle; inverting and reversing the surface of the second shingle so that the projections on the undersurface of the first shingle nest in abutment with the projections of the inverted and reversed second shingle.

3. A composite roofing shingle comprising: (a) a top sheet having an undivided headlap portion having a width and a lower butt portion containing a plurality of spaced tabs having empty spaces therebetween; (b) a backer strip having a top horizontal margin adapted to underlay said top sheet and to fill the empty spaces between said plurality of spaced tabs; and (c) vertical projections positioned on the top horizontal margin of the backer strip which projections extend upwardly at a distance not more than one half the width of said headlap portion and said projections are interposed above the spaces between the tabs, wherein the projections are mirror images of said tabs.

4. The packaging of the composite shingle of claim 3 in pairs which comprise positioning a first shingle of the pair over a second shingle; inverting and reversing the surface of the second shingle so that the projections on the undersurface of the first shingle nest in abutment with the projections of the inverted and reversed second shingle.

* * * * *